US012427391B2

(12) United States Patent
Vielmo

(10) Patent No.: US 12,427,391 B2
(45) Date of Patent: Sep. 30, 2025

(54) SWING TRAINING DEVICE

(71) Applicant: Implus Footcare, LLC, Durham, NC (US)

(72) Inventor: Tommaso Vielmo, San Diego, CA (US)

(73) Assignee: Implus Footcare, LLC, Durham, NC (US)

( * ) Notice: Subject to any disclaimer, the term of this patent is extended or adjusted under 35 U.S.C. 154(b) by 86 days.

(21) Appl. No.: 17/979,569

(22) Filed: Nov. 2, 2022

(65) Prior Publication Data

US 2023/0133819 A1 May 4, 2023

Related U.S. Application Data

(60) Provisional application No. 63/275,153, filed on Nov. 3, 2021.

(51) Int. Cl.
*A63B 69/36* (2006.01)
*A63B 21/00* (2006.01)

(52) U.S. Cl.
CPC ..... *A63B 69/3667* (2013.01); *A63B 21/4017* (2015.10); *A63B 69/3608* (2013.01)

(58) Field of Classification Search
CPC ..... A63B 69/3667; A63B 21/4017; A63B 69/3608; A63B 2071/0655; A63B 2102/32; A63B 2209/10; A63B 2225/09; A63B 69/0059
USPC ..... 473/205–207, 212, 213, 219, 226, 227, 473/256, 266, 276
See application file for complete search history.

(56) References Cited

U.S. PATENT DOCUMENTS 1,655,092 A 1/1928 Davis
3,408,078 A * 10/1968 Falerni ..... A63B 69/3608 473/208
4,273,336 A 6/1981 Larkey
4,572,167 A * 2/1986 Brunswick ..... A61F 13/04 2/908
5,085,437 A * 2/1992 Leitao ..... A63B 69/0059 473/212
5,145,179 A * 9/1992 Breed ..... A63B 69/0059 273/DIG. 30

(Continued)

FOREIGN PATENT DOCUMENTS

JP 5582374 B1 7/2014
WO 9323123 A1 11/1993

(Continued)

OTHER PUBLICATIONS

PCT/US2022/079170 , "International Search Report and the Written Opinion," mailed Jan. 30, 2023 14 pages.
EP22817493.4 , "Office Action", Apr. 24, 2025, 7 pages.

*Primary Examiner* — Nini F Legesse
(74) *Attorney, Agent, or Firm* — Kilpatrick Townsend & Stockton LLP

(57) ABSTRACT

A swing training device for practicing a sports swing that includes a body having a first end region and a second end region and a receiving slot extending along the body. At least one attachment member is received within the receiving slot and is adapted to couple the first end region and the second end region to define a hollow shape. In some embodiments, the first end region and the second end region are adapted to translate relative to each other along the slot.

20 Claims, 13 Drawing Sheets

(56) References Cited

U.S. PATENT DOCUMENTS

| | | | | |
|---|---|---|---|---|
| 5,203,567 | A | 4/1993 | Erlinger et al. | |
| 5,259,621 | A * | 11/1993 | Keefer | A63B 69/0059 473/227 |
| 5,294,126 | A | 3/1994 | Armstrong, III | |
| 5,421,809 | A * | 6/1995 | Rise | A61F 5/028 602/19 |
| 5,439,214 | A | 8/1995 | Dalbo | |
| 5,445,385 | A * | 8/1995 | Brooks | A63B 69/0059 473/214 |
| 5,447,312 | A | 9/1995 | Nixon et al. | |
| 5,711,716 | A * | 1/1998 | O'Brien | A63B 69/3676 473/212 |
| 5,902,189 | A * | 5/1999 | Schultz | A63B 69/0059 473/212 |
| 7,635,308 | B2 | 12/2009 | Merrill | |
| 7,758,437 | B1 * | 7/2010 | Stewart | A63B 69/3608 473/409 |
| 7,896,756 | B2 | 3/2011 | Choi | |
| 7,976,398 | B2 | 7/2011 | Clawson | |
| 8,043,171 | B2 | 10/2011 | Huffman et al. | |
| 8,128,507 | B1 | 3/2012 | Chuck | |
| 8,221,255 | B1 * | 7/2012 | Wang | A63B 69/3632 473/409 |
| 8,277,402 | B2 * | 10/2012 | Chisena | A61F 5/0118 602/20 |
| 9,072,957 | B1 | 7/2015 | Chuck | |
| 9,533,211 | B1 | 1/2017 | Watson | |
| 9,737,779 | B2 | 8/2017 | Watson | |
| D868,918 | S | 12/2019 | Oyler et al. | |
| 10,813,783 | B1 * | 10/2020 | Hawkins | A61F 5/028 |
| D922,511 | S | 6/2021 | Arnold et al. | |
| 11,027,184 | B2 | 6/2021 | Gankas | |
| 11,369,387 | B2 * | 6/2022 | Nivens | A61B 17/1322 |
| 2006/0154738 | A1 | 7/2006 | Larsen | |
| 2008/0026863 | A1 * | 1/2008 | Eck | A63B 69/3623 473/212 |
| 2009/0181787 | A1 * | 7/2009 | Lane | A63B 69/0057 473/212 |
| 2009/0197692 | A1 | 8/2009 | Eck | |
| 2019/0275398 | A1 | 9/2019 | Bean | |
| 2021/0052963 | A1 | 2/2021 | Chuck et al. | |
| 2021/0220716 | A1 | 7/2021 | Gankas | |
| 2021/0379461 | A1 * | 12/2021 | Mulloy | A63B 69/0059 |

FOREIGN PATENT DOCUMENTS

| | | | |
|---|---|---|---|
| WO | 9611040 | A1 | 4/1996 |
| WO | 9954003 | A1 | 10/1999 |
| WO | 2006020140 | A2 | 2/2006 |
| WO | 2009064123 | A1 | 5/2009 |
| WO | 2011155925 | A1 | 12/2011 |

* cited by examiner

SWING TRAINING DEVICE

CROSS-REFERENCE TO RELATED APPLICATIONS

This application claims the benefit of U.S. Provisional Application 63/275,153, filed on Nov. 3, 2021, the entire contents of which is incorporated herein in its entirety.

TECHNICAL FIELD

The disclosure herein generally relates to a training device for sports performance, and more particularly, to a training device for improving the swinging technique of a golf player.

BACKGROUND

In many ball-related sports, such as golf, baseball, and hockey, players often swing a sports implement (e.g. a club, stick, or bat) at high speeds. A player often benefits from swinging the sports implement in a consistent manner, as it allows for increased control in performing the sport. Frequently, both the amount of force applied by the sports implement as well as the consistency in which a player can swing the sports implement are highly dependent on having a desirable swinging form or technique.

One aspect of a desirable swinging technique with sports implements, for example a golf club, is for the forearms of the player to stay in close proximity with each other for the duration of the swing. "Shallowing the golf club" refers to a desirable trait of a golf swing, where the rotation of the golf club is maximized horizontally during the downswing. Many amateur or inexperienced golfers tend to swing towards the golf ball in a vertical motion ("chopping"), where the head of the golf club is directly or nearly directly above the handle of the club during the downswing motion. Training a golfer's forearms to stay close together during the swing may help encourage a shallow swing.

Accordingly, a need exists for an improved swing training device for sports training, which provides for precise size adjustment and usability for a wide range of body types.

SUMMARY

The terms "invention," "the invention," "this invention" and "the present invention" used in this patent are intended to refer broadly to all of the subject matter of this patent and the patent claims below. Statements containing these terms should be understood not to limit the subject matter described therein or to limit the meaning or scope of the patent claims below. Embodiments of the invention covered by this patent are defined by the below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Aspects of the present disclosure are related to a swing training device with adjustable sizing capabilities. In particular, embodiments of the present disclosure provide for a golf swing training device with a body portion having a surface sized and shaped to receive the forearms of a user.

The swing training device can be coupled to an appendage of the user, for example the user's forearm, via a strap or other securing feature. The swing training device can have an first end region that overlaps a second end region to form an overlapping loop, or, in use, a generally hollow, cylindrical shape. The first end region can be coupled to the second end region such that the respective end regions may slide relative to one another upon an application of force by the user's forearms, thereby altering the diameter of an inner region of the body. The body of the swing training device may be size-adjustable to allow for the body to precisely fit between the forearms of a particular user by allowing the first end region to slide relative to the second end region along a length of a slot in the body. The device may provide tactile feedback via the movement of the first end region relative to the second end region to aid in training the user to maintain their elbows in close proximity to each other during a golf swing.

In one aspect, the body of the swing training device has an elongated, curved shape (e.g. a loop, c-shape, or open circle) defining a first end region and second end region at a first end and a second end of the body, respectively. The shape of the body may allow for the end regions to adjustably overlap one another, such that the circumference of the body may decrease, providing size adjustability. As such, when positioned between the forearms of a user, pressure may be applied to the outer surface of the body, causing an increase in the overlap between the end regions. From a side perspective, an outer surface of the body may have a concave shape to conform to the shape of a forearm of a user. The body may be constructed from a flexible or otherwise temporarily deformable material, and thus may be configured to bend or flex.

In one aspect, the body may include a receiving slot which extends circumferentially around at least a portion of the body, such as spanning near the second end region of the body. The first end region and second end region of the body may be overlapped, and an attachment member may be inserted through an opening in the first end region and the receiving slot adjacent the second end region, such that the end regions are coupled together. While coupled via the attachment members, the end regions may still move or slide horizontally relative to each other, by the attachment member moving horizontally within the receiving slot along a length of the second end region. The attachment member may be relatively fixed in place relative to the first end region as it passed through the opening in the body adjacent or proximate to the first end region. As such, the diameter of the inner area of the body may be adjusted via movement of the attachment member along the length of the receiving slot. In various embodiments, the attachment member may include a bolt and a fastener.

In one aspect, the swing training device may include a comfort member, dimensioned to attach to attach to at least a portion of the outside of the body. The comfort member may provide cushioning or reduce fiction between the body of the swing training device and the forearms of the user.

In one aspect, the swing training device may include an arm attachment which couples to the body of the swing training device. For example, the arm attachment may be a strap, belt, an elastic band, a Velcro strap, or similar device to attach the swing training device to the forearm of the user.

An embodiment of the present invention relates to a swing training device for practicing a sports swing that include a body having a first end region and a second end region, and a receiving slot extending along a length of the body. At least one attachment member is received within the slot and adapted to couple the first end region and the second end region to define a hollow shape. In some embodiments, the first end region and the second end region are adapted to translate relative to each other to alter the hollow shape itself and/or the area of the hollow shape.

BRIEF DESCRIPTION OF THE DRAWING FIGURES

These and other features and advantages of the claimed invention will become more readily apparent to those skilled in the art upon reading the following detailed description, in conjunction with the appended drawings in which:

Figure 1:
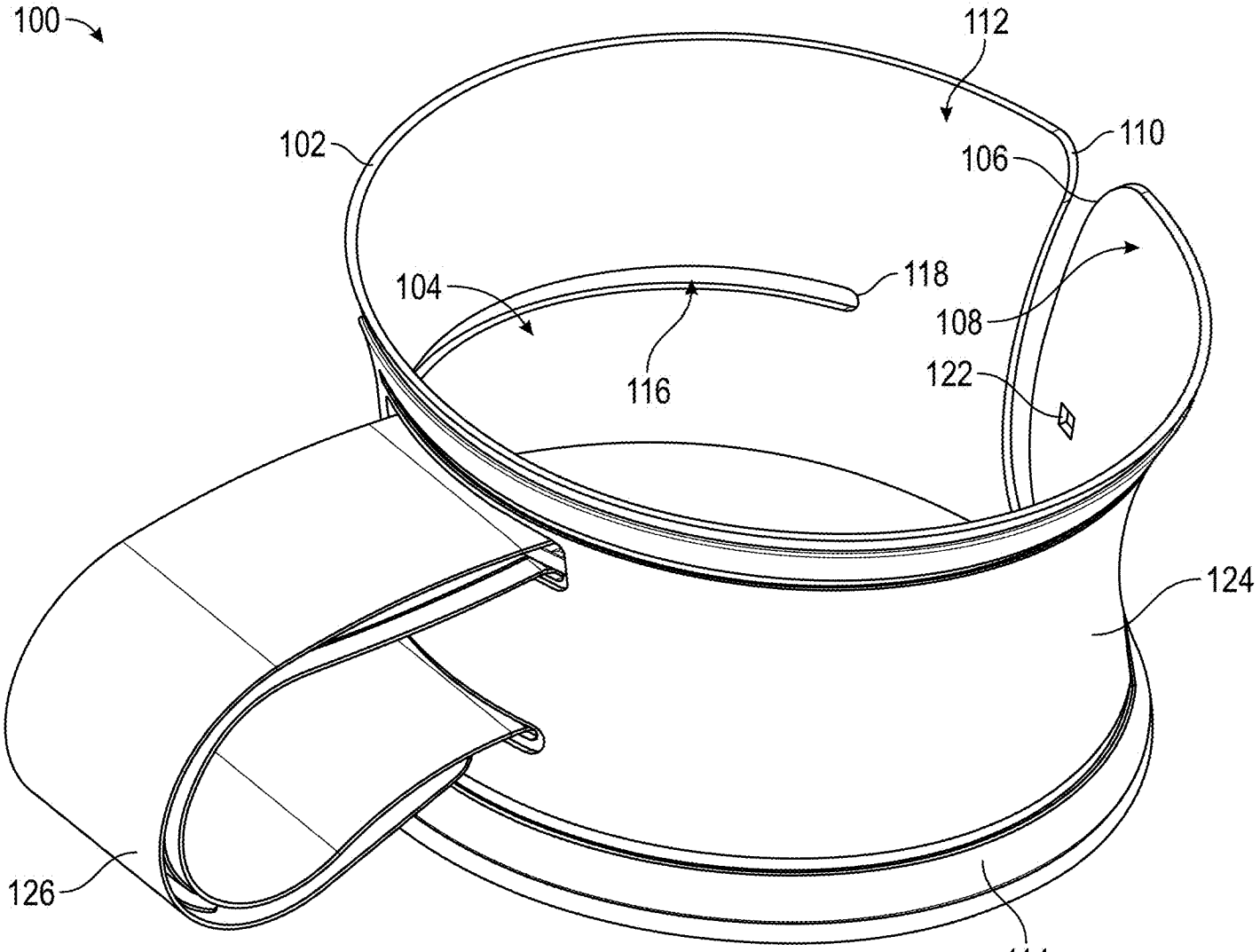
FIG. 1 illustrates a perspective view of an exemplary swing training device according to various embodiments of the present disclosure.
Figure 6:
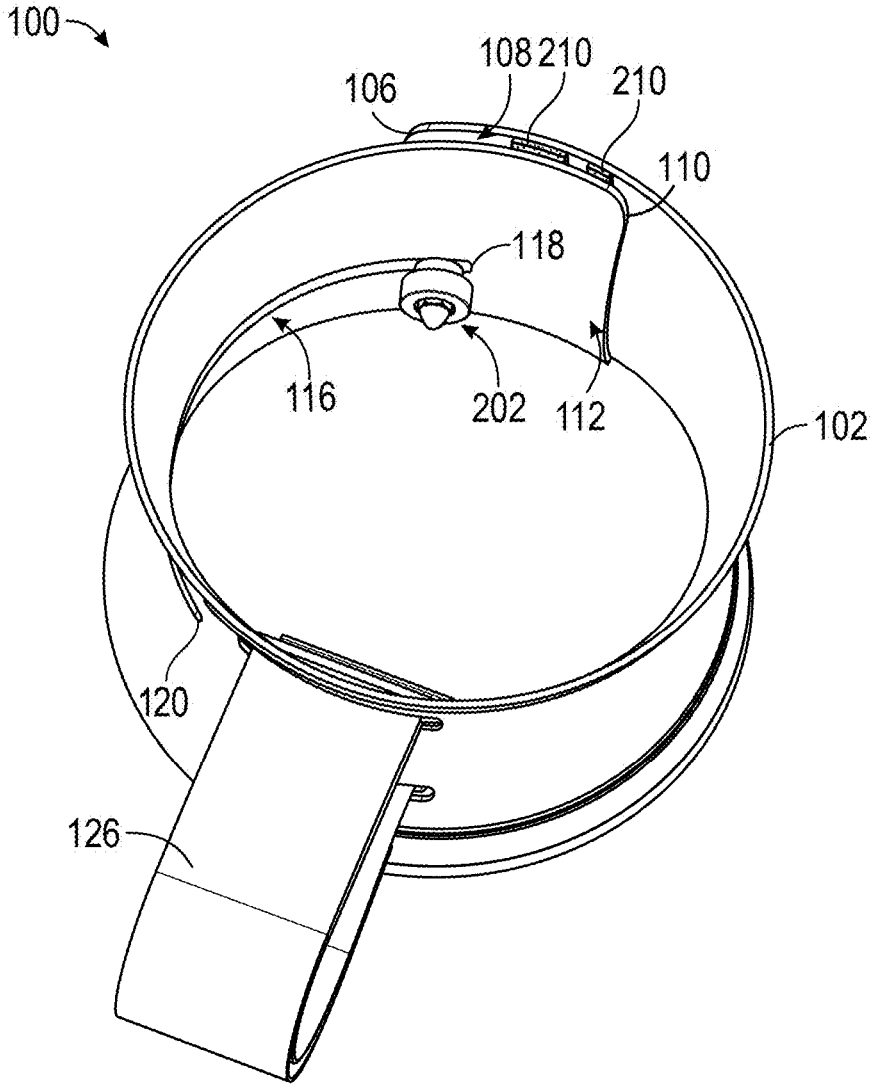
Figure 7:
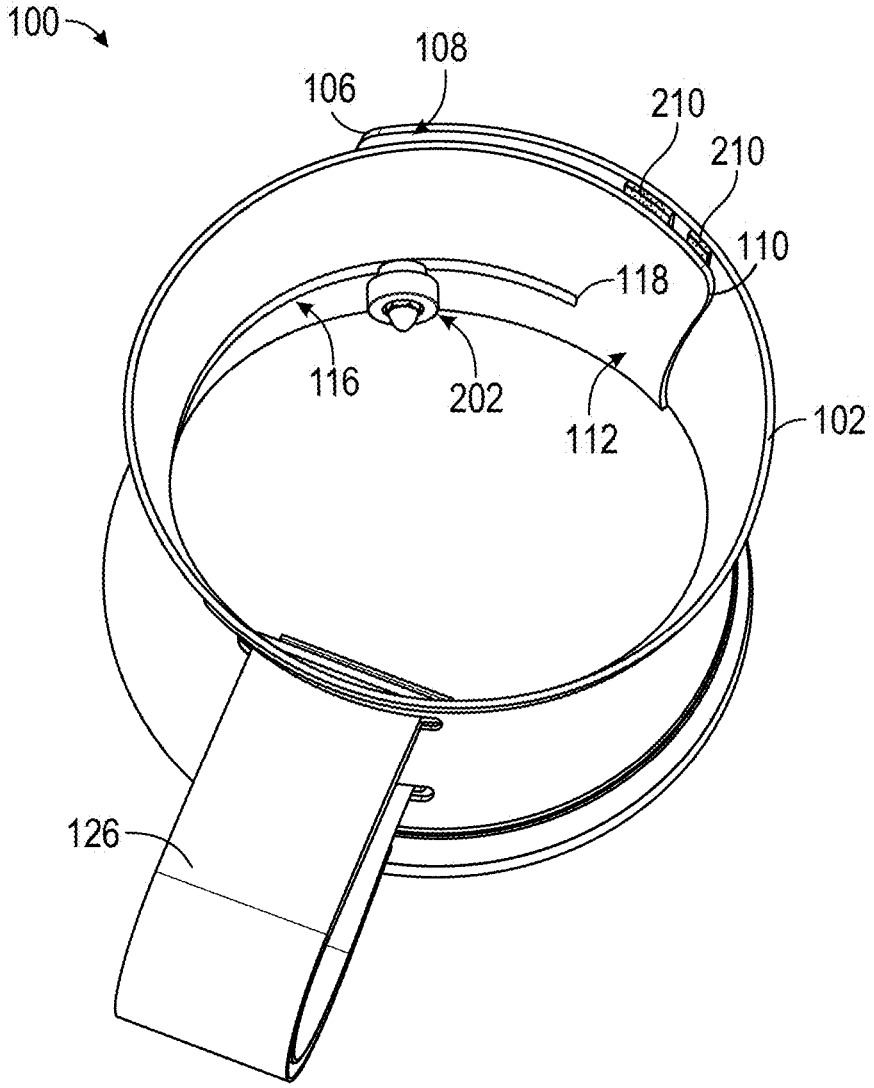

FIG. 6 illustrates a perspective view of the swing training device of FIG. 1, illustrating a first end region and a second end region overlapping according to various embodiments of the present disclosure FIG. 7 illustrates a perspective view of the swing training device of FIG. 1, illustrating a first end region and a second end region overlapping according to various embodiments of the present disclosure.

Figure 8:
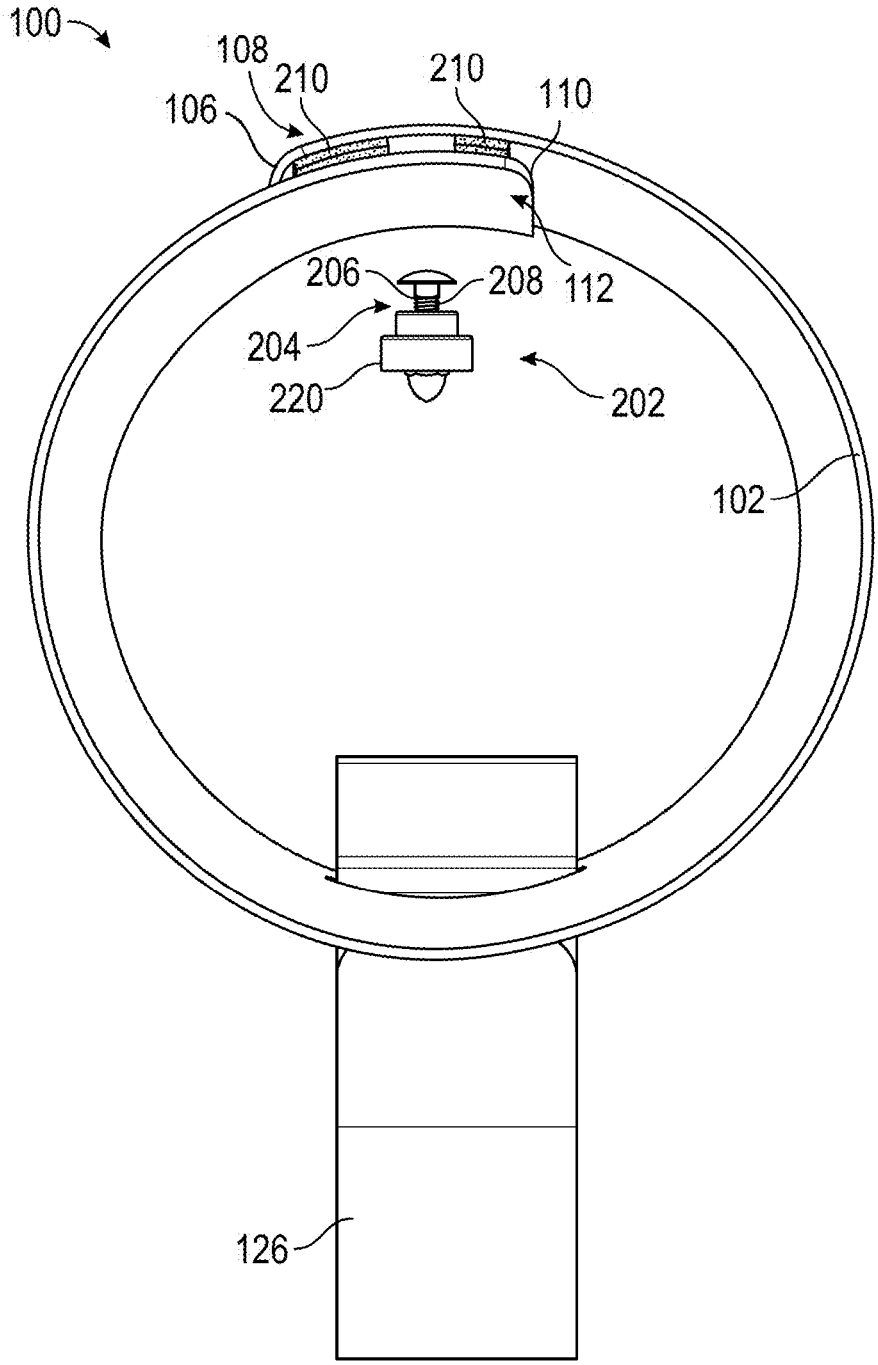

FIG. 8 illustrates a top view of the swing training device of FIG. 1, illustrating exemplary a first end region and a second end region overlapping according to various embodiments of the present disclosure.

Figure 9:
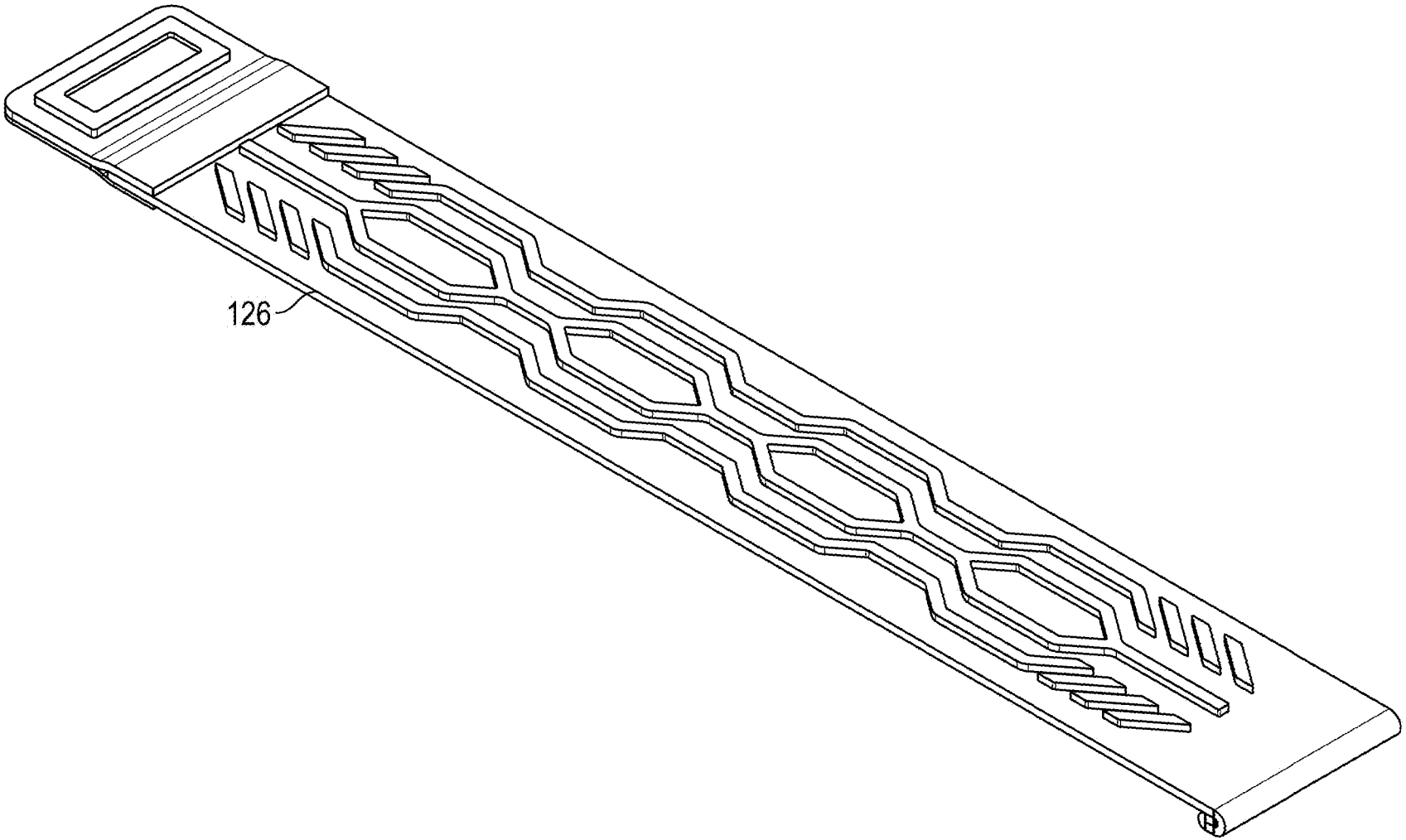

FIG. 9 illustrates a perspective view of an arm attachment according to various embodiments of the present disclosure.

Figure 10:
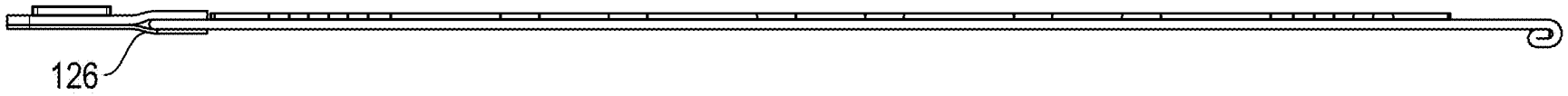

FIG. 10 illustrates a side view of the arm attachment of FIG. 7 according to various embodiments of the present disclosure.

Figure 11A:
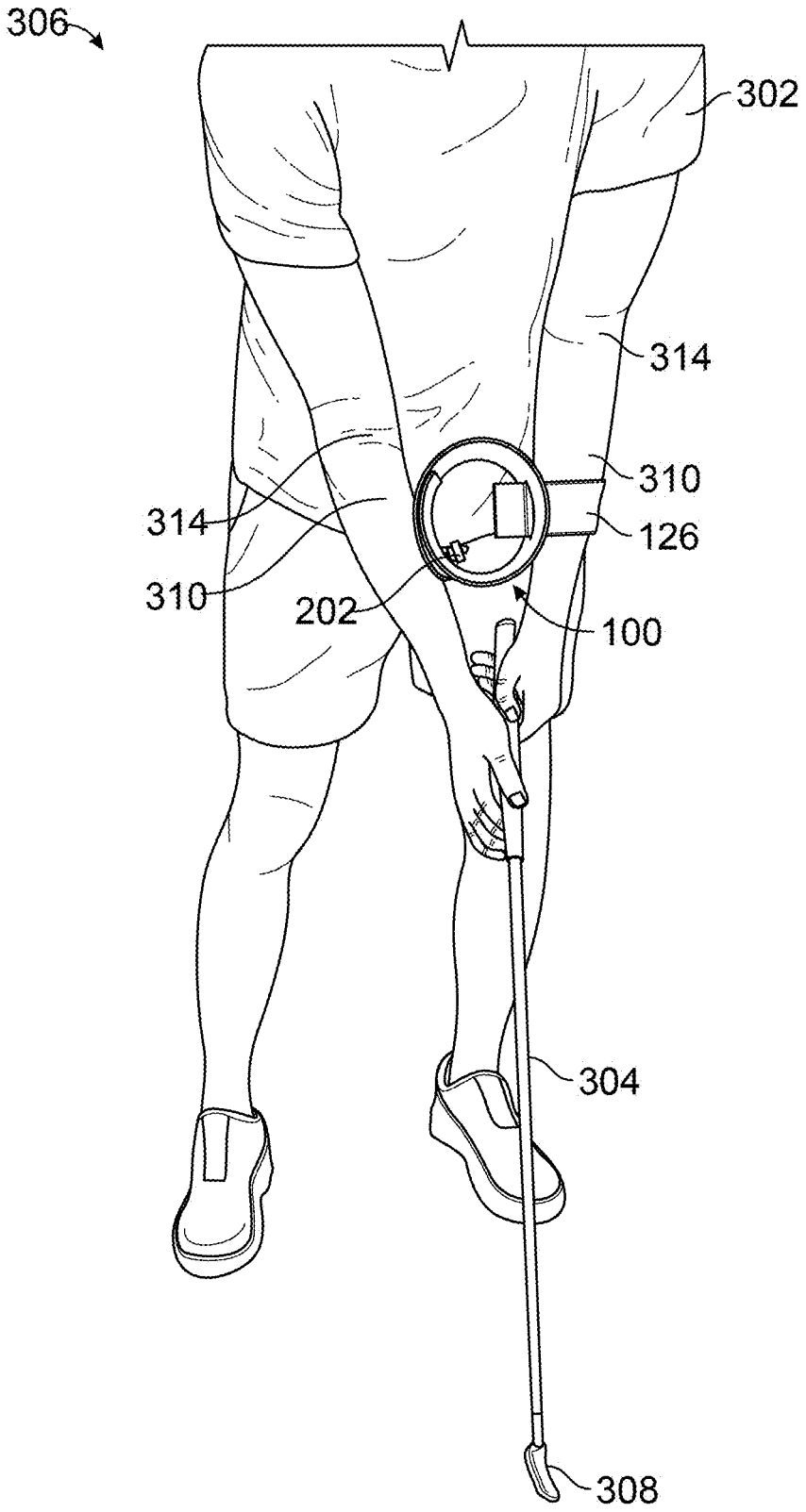
Figure 11B:
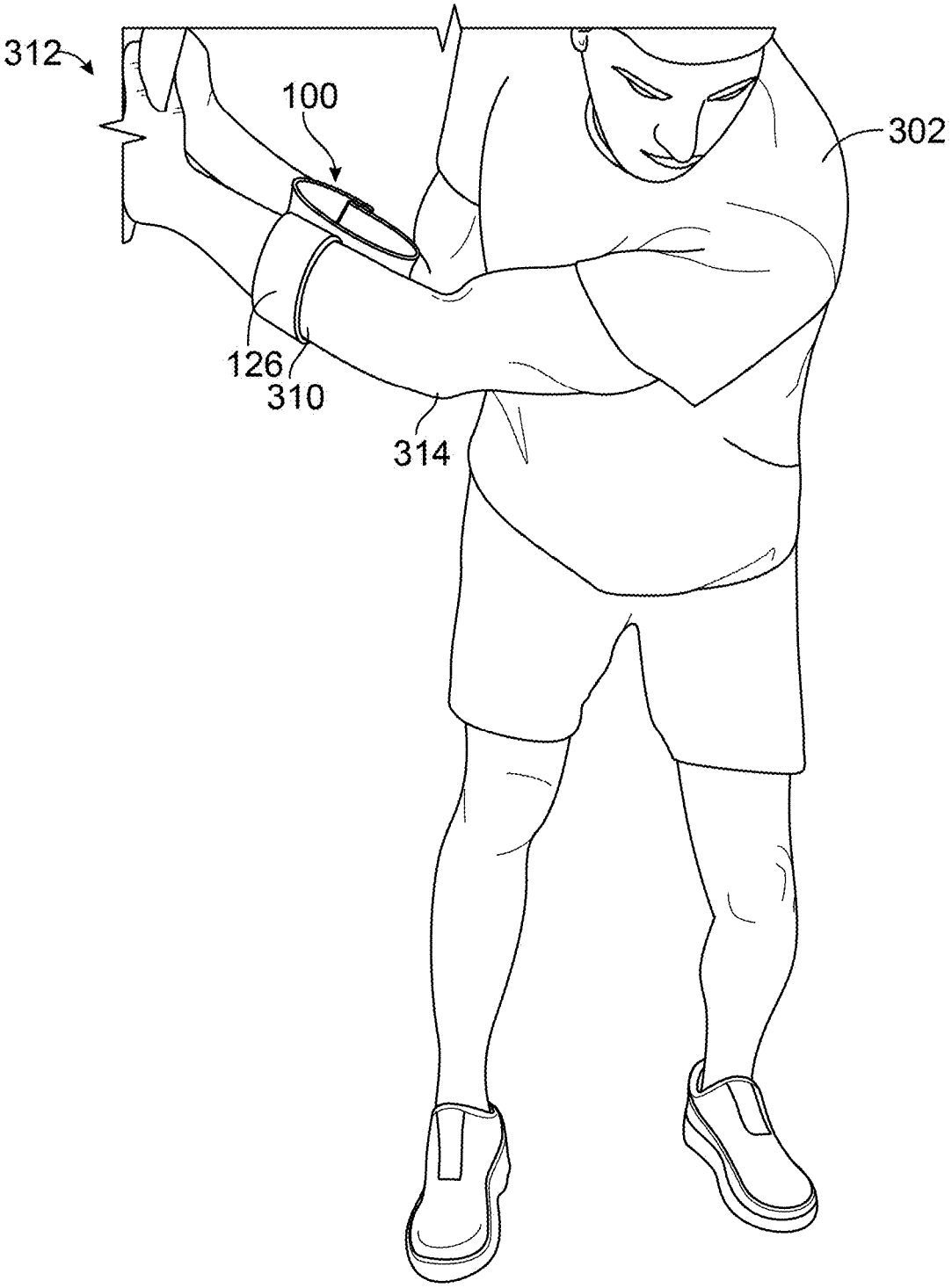
Figure 11C:
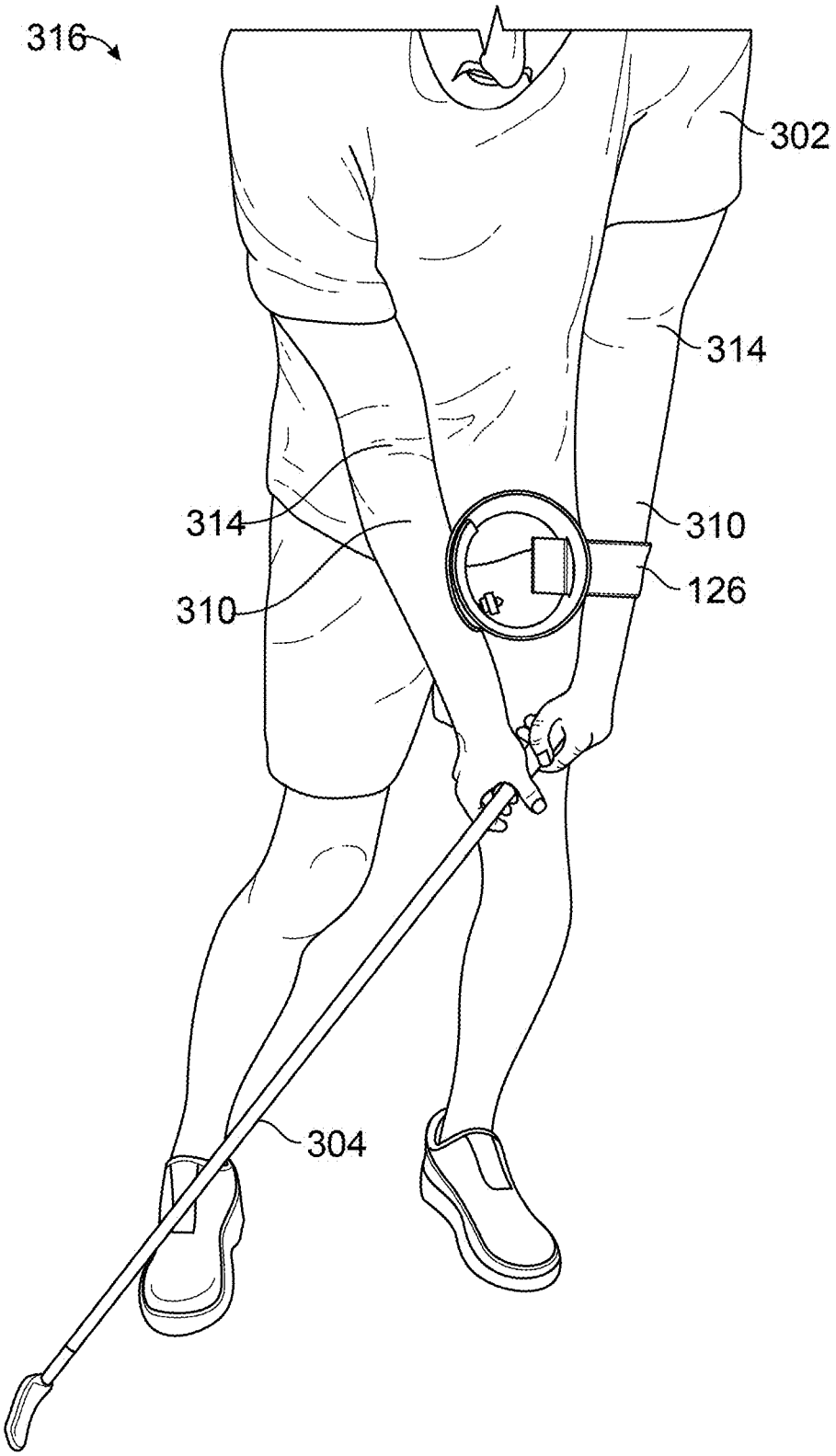

FIGS. 11A-11C illustrate the swing training device of FIG. 1 in a starting position, back-swing position, and a front-swing position, respectively.

DETAILED DESCRIPTION

Figure 2:
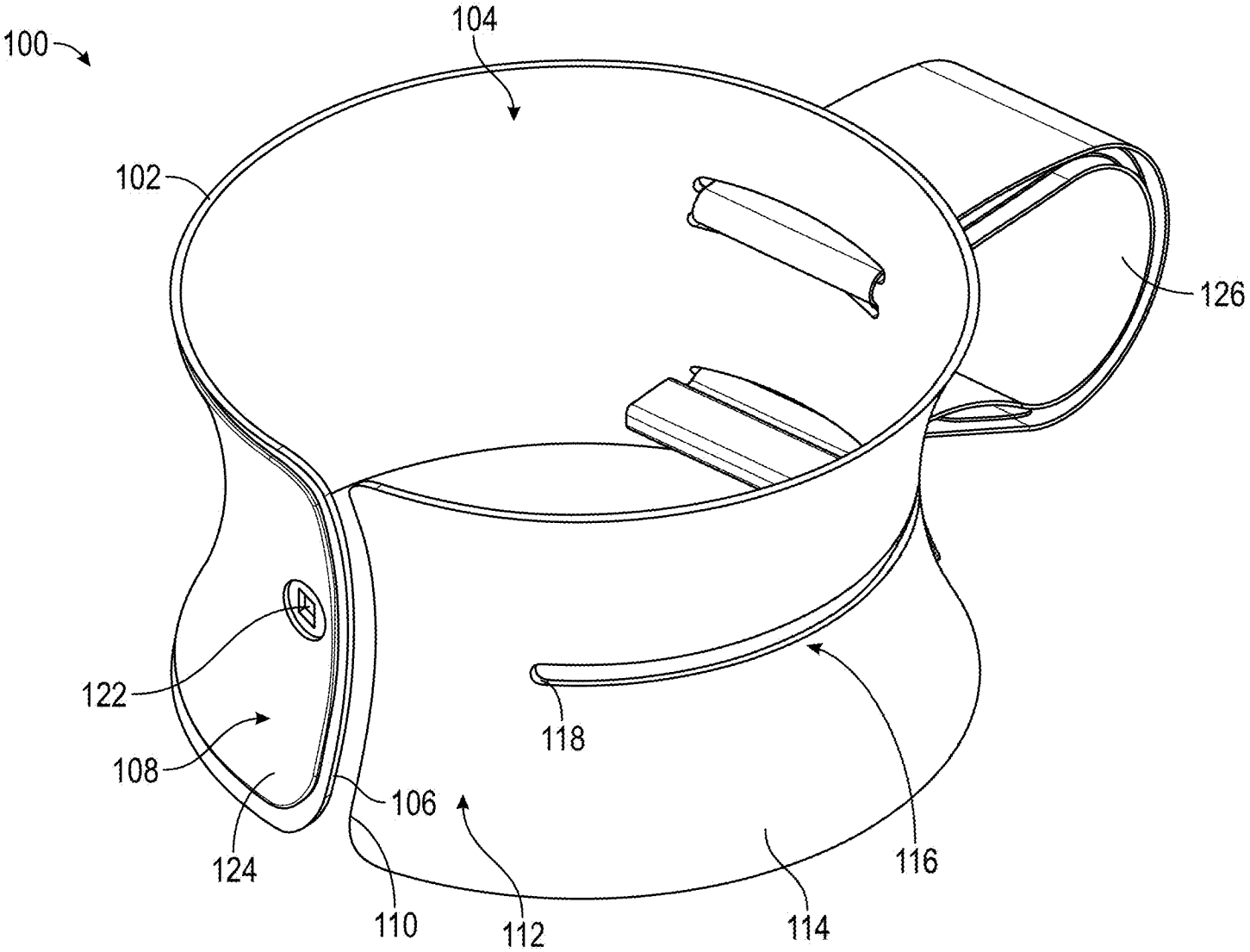
FIG. 2 illustrates an alternative perspective view of the swing training device of FIG. 1.
Figure 3:
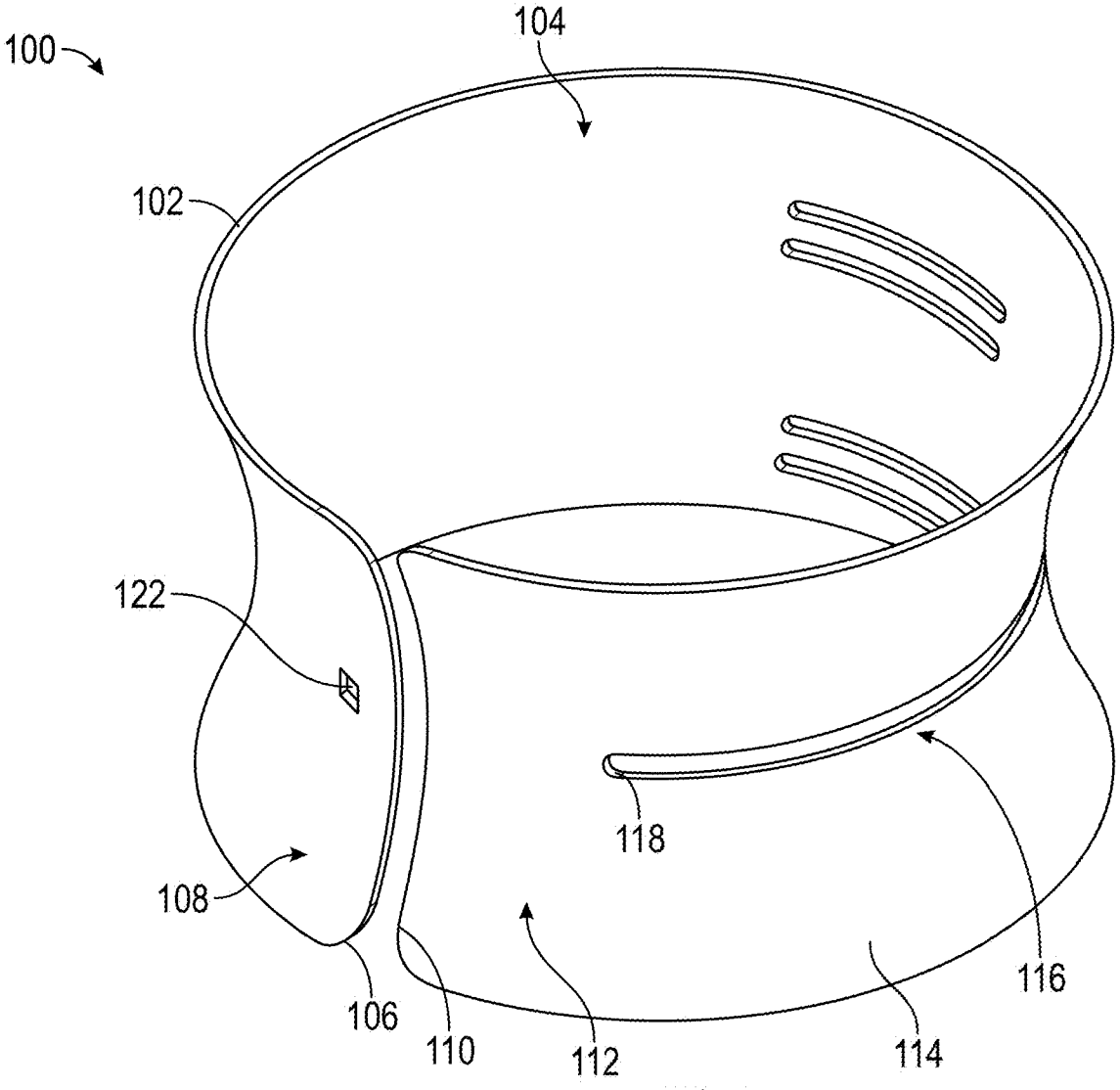
FIG. 3 illustrates a perspective view of a body in isolation according to various embodiments of the present disclosure.
Figure 4:
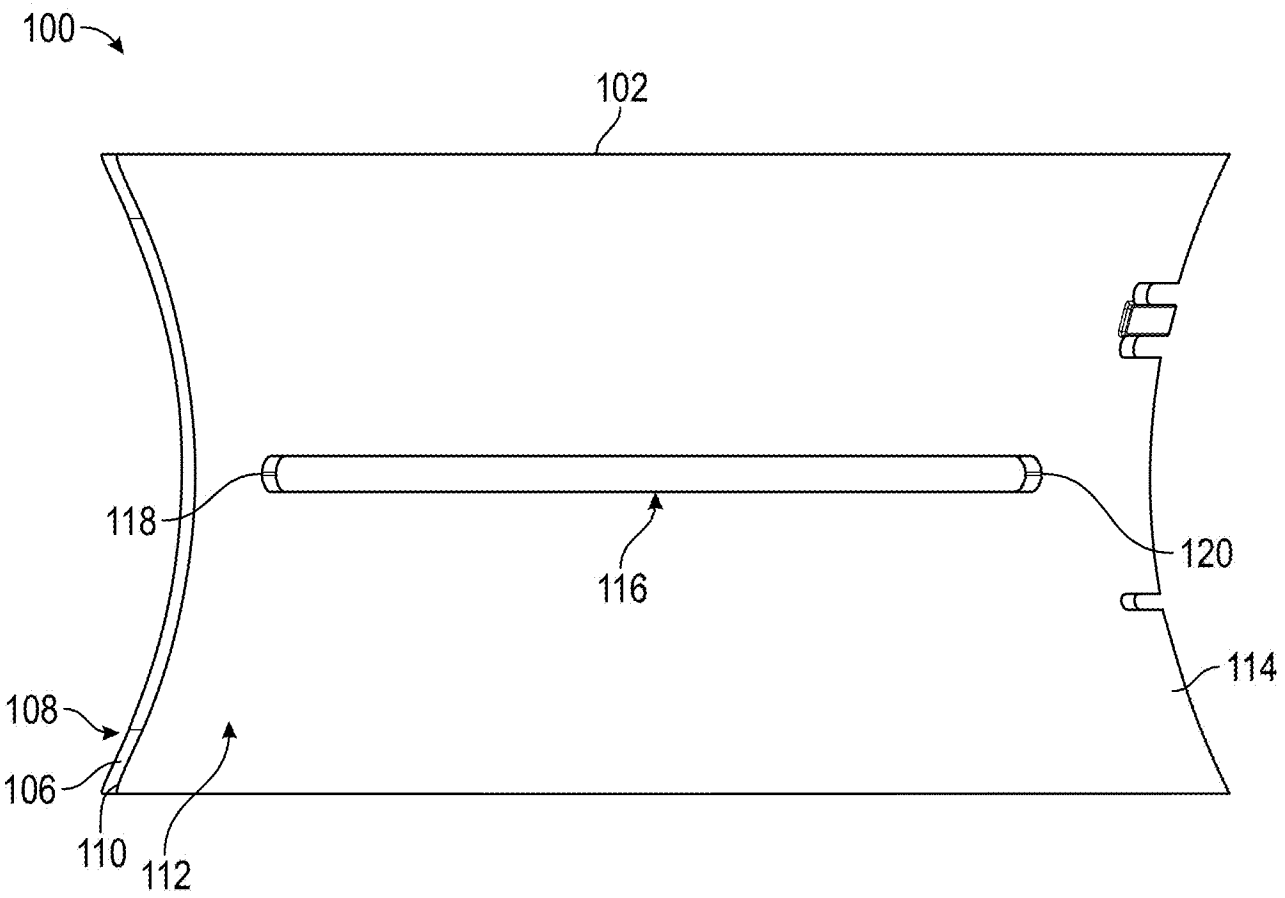
FIG. 4 illustrates a side view of the body of FIG. 3 in isolation.
Figure 5:
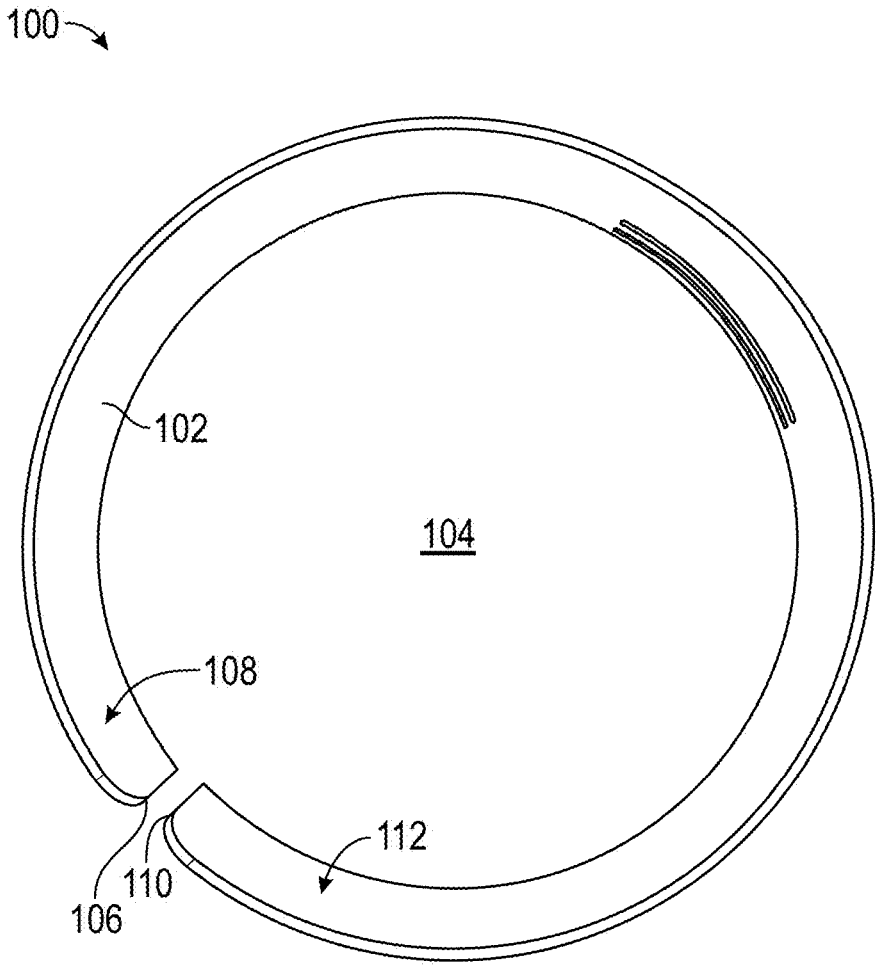
FIG. 5 illustrates a top view of the body of FIG. 3 in isolation.

FIGS. 1 and 2 illustrate front and rear prospective views, respectively, of an exemplary swing training device 100, for example a golf swing training device, according to various embodiments of the present disclosure. The swing training device 100 may include a body 102 having, in use, a generally hollow, cylindrical shape defining a first end 106 and a second end 110. For example, the body 102 may have an open loop shape, such as a c-shape or open circle, though in some aspects the body 102 may form a complete loop. The swing training device 100 may have an interior area 104 which is open (hollow). As shown in FIGS. 3-5, which depicts the body 102 in a perspective, top, and side view respectively, the body 102 may have a first end region 108 proximate the first end 106 and a second end region 112 proximate the second end 110. The body 102 may be dimensioned such that the first end 106 is radially distanced from the interior area 104 more than the second end 110 (or vice versa), such that the first end region 108 may overlap on top of the second end region 112 (see, e.g., FIGS. 6 and 7). For example, when force or pressure is applied to the exterior surface 114 of the body 102, the first end region 108 may overlap (or further overlap) the second end region 112, such that the diameter of the interior area 104 of the body 102 decreases. Similarly, when the force or pressure is removed or reduced, the first end region 108 and second end region 112 may move relative to each other such that the diameter of the interior area 104 increases.

The exterior surface 114 of the body 102 may be a concave, hyperboloid or hour-glass shape. For example, the concave shape of the exterior surface 114 may provide a surface that conforms to the shape of a forearm or forearms of a user.

The body 102 may be constructed from a flexible or otherwise temporarily deformable material, and thus may be configured to bend. In some aspects, the body 102 may be flexible to deform to a generally linear shape, such that the first end region 108 and second end region 112 are planar and opposite each other. For example, providing flexibility may allow for the swing training device 100 to be more compact for storage and shipping purposes. In various embodiments, the body 102 may not be flexible enough to allow the body 102 to deform to a linear shape, such that the body 102 is more rigid for use.

The body 102 may further include a receiving slot 116 having a first end 118 and a second end 120 opposite the first end 118. The receiving slot 116 may extend partially or entirely through the thickness of the body 102. The receiving slot 116 may extend circumferentially around at least a portion of the body 102. In various aspects, the receiving slot 116 may extend around between 25% to 75% of the circumference of the body 102. However, the receiving slot 116 may extend around less or more of the circumference of the body 102. The first end 118 of the receiving slot 116 may be, but does not have to be, positioned more proximate the second end 110 of the body 102 than the first end 106. As such, the receiving slot 116 may be circumferentially more proximate the second end 110 than the first end 106. In various aspects, the receiving slot 116 may extend at a uniform height along the body 102 in that the receiving slot 116 is located a distance from one of the top or bottom edges of the body 102 that is consistent along the length of the receiving slot 116. However, in other embodiments, such distance may vary along the length of the receiving slot 116.

The body 102 may include an opening 122 proximate to the first end 106. When the first end region 108 and the second end region 112 are sufficiently overlapped, the opening 122 may align with a portion of the receiving slot 116 such that one or more attachment members may extend through the opening 122 and the receiving slot 116 to couple the first end region 108 and the second end region 112. The movement of the first end region 108 and the second end region 112 may be limited by the one or more attachment members, for example to retain the end regions 108, 112 in an overlapped position. In some aspects, the one or more attachment members may be moveable to various positions within the receiving slot 116 such that the first end region 108 and second end region 112 may be adjustably overlapped with one another, permitting the diameter of the body 102 to vary. Exemplary, non-limiting, attachment members are discussed in detail below.

In various aspects, the swing training device 100 may include a comfort member 124, which may be dimensioned to attach or couple to the exterior surface 114 of the body 102. The comfort member 124 may wrap partially or entirely around the circumference of the exterior surface 114 of the body 102. In various aspects, the comfort member 124 may be removable from the body 102, such as for cleaning or replacement. The comfort member 124 may be made from a foam material, a deformable plastic, fabric, or similar material to provide comfort to the forearms of the user during use. Similarly, the comfort member 124 may be made of a material which reduces friction between the forearms of the user and the body 102 of the swing training device 100, to prevent or reduce rubbing or chafing of the forearms.

In various aspects, the swing training device 100 may include an arm attachment 126 which couples the body 102 of the swing training device 100 to the user. For example, the body 102 may include openings to provide for the arm attachment 126 to loop or otherwise attach to the body 102. As shown in FIGS. 9 and 10, which illustrates the arm attachment 126 in a perspective view and a side view, the arm attachment 126 may be, for example, a strap, belt, an elastic band, a Velcro strap, or similar device. Functionally, the arm attachment 126 may attach to the forearm of a user to removably attach the swing training device 100 to the user. In various embodiments, the swing training device 100 may include a plurality of arm attachments 126 which may attach to the same forearm of a user or may attach to both arms of the user.

The arm attachment 126 may receive a forearm of a user. For example, in some aspects the arm attachment 126 may include a belt or Velcro. In such aspects, the belt may be loosened for inserting the arm and then retightened to the desired tightness, such that the swing training device 100 is secured to the arm. The swing training device 100 may be attached to either forearm (or in some aspects, both forearms) of the user. For example, the swing training device may be coupled to the "front forearm" of the user—the arm facing towards the direction they wish to project the ball (generally the non-dominant arm). In such aspects, by only attaching the swing training device 100 to one arm, the user may still retain full function of their arms, such that the user may be able to change clubs, or perform other tasks with their arms, without their arms being bound together by the training device 100.

In some aspects, the swing training device 100 may not include an arm attachment 126. The body 102 of the swing training device 100 may be placed between the forearms of the user and maintained in position by pressure applied between the forearms.

FIGS. 6-8 illustrates the assembled swing training device 100 The swing training device 100 may include one or more attachment members 202. As discussed above, the opening 122 in the body 102 proximal to the first end 106 may be aligned with a portion of the receiving slot 116 such that the one or more attachment members 202 may be inserted through the receiving slot 116 and the opening 122. The one or more attachment members 202 may include, for example, a bolt 204 which may be inserted through the opening 122 from the exterior surface 114 of the body 102. The bolt 204 may include a shaft 206 including a threaded portion 208 at the distal end of the shaft 206, and an unthreaded portion proximal to the head of the bolt 204. The bolt 204 may be positioned through the opening 122 and through the receiving slot 116. For example, the threaded portion 208 of the bolt 204 may not extend all the way to the proximal portion of the bolt 204 (near the head), thus the shaft 206 may have a neck portion, near the head of the bolt 204, which does not have threading. This section may be cylindrical (e.g. a shank) or may otherwise include a stop (e.g. a square neck). For example, the bolt 204 may be a carriage bolt, having a rounded head and square neck. To accommodate these different designs of the bolt 204, the opening 122 and/or the receiving slot 116 may be sized and shaped appropriately to receive the bolt 204. For example, the opening 122 may be square for a bolt 204 having a square neck, or the opening 122 may be round to receive a bolt 204 with a cylindrical shank.

While discussed herein that the body 102 may include the opening 122, this feature does not require that the bolt 204 be removable from the body 102. In various embodiments, the bolt 204 may be permanently attached to (or incorporated in) the first end region 108 of the body 102, and thus may be incorporated as a component of the body 102.

The one or more attachment members 202 may further include a fastener 220 which may thread on to the distal end of the bolt 204 to retain the bolt within the receiving slot 116. In some aspects, the fastener 220 may be fully tightened (threaded) on the bolt 204, and yet the fastener 220 may not fully tighten against the head of the bolt 204. For example, the unthreaded portion of the shaft 206 of the bolt 204 may inhibit the fastener 220 from contacting the head of the bolt 204, such that a space is maintained. As such, the unthreaded portion of the shaft 206 may be configured to at least extend through the receiving slot 116 of the second end region 112, such that the second end region 112 is not fully secured relative to the first end region 108 and may therefore slide relative to the first end region 108 as the attachment member 202 slides within the receiving slot 116.

In various aspects, the location of the bolt 204 and fastener 220 may be reversed, such that the bolt 204 is inserted through the receiving slot 116 and opening 122 towards the exterior surface 114. Further, while specific features of the bolt 204 and fastener 220 are discussed herein at length, further embodiments are contemplated for alternative attachment members 202 to provide the function of the bolt 204 and faster 220 discussed herein. For example, various attachment devices may be used to hold the first end region 108 over the second end region 112 yet still allow relative sliding between the two regions 108, 112 so as to vary the diameter of the body 102. Various latching mechanisms, fasteners, clips, snaps, hooks, and locking devices are contemplated to perform this function.

The one or more attachment members 202 may restrict movement of the first end region 108 and the second end region 112 relative to each other. More specifically, the attachment member 202 may prevent the first end region 108 and the second end region 112 from sliding relative to each other beyond the first end 118 and the second end 120 of the receiving slot 116. In this way, a maximum and minimum diameter of the body 102 is defined. Said interaction is shown in FIG. 6 and FIG. 7, which depict a perspective view of the swing training device 100 with the attachment member 202 positioned in different locations along the length of the receiving slot 116.

The attachment members 202 may be selected with specific dimensional characteristics to provide the desired friction between the first end region 108 and the second end region 112. For example, when using the swing training device 100, it may be desirable to have some friction between the first end region 108 and second end region 112 to provide "resistance." Thus, when the user is swinging a sports implement (e.g. golf club) with the swing training device 100, if the forearms of the user separate (i.e. due to poor form) the body 102 of the swing training device 100 does not immediately expand. As such, the resistance provides tactile feedback to the user that they have separated their forearms from contact with the body 102 of the swing training device 100. Conversely, as discussed below, the user may apply pressure on the exterior surface 114 of the body 102 to conform the size of the body 102 to the spacing between the forearms of the user. As such, it is desirable for the friction to not be so high that a user has difficultly in adjusting such sizing of the body 102.

The swing training device 100 may optionally include one or more pads 210, which may be attached to either or both of the first end region 108 and/or the second end region 112. The pads 210 may be interposed between the first end region 108 and the second end region 112. For example, the pads 210 may be made of a material configured to reduce or limit friction between the first end region 108 and the second end region 112, such that the first end region 108 and second end region 112 may slide with less force relative to each other. The pads 210 may not be included in the switch training device 100, for example where the first end region 108 and the second end region 112 slide relative to one another with a sufficiently low frictional resistance.

FIGS. 11A-11C illustrate the swing training device 100 in various use positions as a user 302 swings a golf club 304.

FIG. 11A illustrates the position of the swing training device 100 when a swing of a user 302 is at a starting position 306. In the starting position 306, the golf club 304 may be positioned facing downwards such that the head 308 of the golf club 304 is stationary near the ground. In various embodiments, the head 308 may be positioned relative to a golf ball, such as to align the swing of the user 302 with the golf ball. Similar orientations may be utilized for various sports, as discussed above.

As shown in FIG. 11A, in the starting position 306, the swing training device 100 may be attached to the forearm 310 of the user 302 with the arm attachment 126. As shown in the figure, the arm attachment 126 attaches the swing training device 100 to one of the forearms 310, specifically the front (or lead) forearm. In various embodiments, the arm attachment 126 may attach to the back forearm, or to both forearms. As shown in the figure, the comfort member 124 contacts each of the forearms 310 of the user 302. Specifically, the forearms 310 fit within the concave outer shape of the exterior surface 114 of the body 102.

While positioned between the forearms 310, the first end region 108 overlaps the second end region 112, and the first end region 108 and the second end region 112 are coupled together via one or more attachment members 202. Specifically, a fastener 220 (e.g. a nut) is shown within the interior area 104 of the body, and is attached to the bolt 204 extending through the receiving slot 116.

When pressure is applied by the forearms 310 of the user 302 on the body 102 of the swing training device 100, the interior area 104 of the body 102 contracts. For example, the body 102 may assume a more elongated cross-sectional shape, such as an oval shape, where a first cross-wise dimension of the interior area 104 (e.g., the height) decreases and a second cross-wise dimension of the interior area 104 (e.g., the width) increases as a result of the pressure on the body 102 by the forearms 310. Alternatively, the interior area 104 may stay generally circular but the area of the interior area 104 may be reduced when the body 102 is subjected to pressure.

FIG. 11B shows the user 302 in a backswing position 312 such that the golf club 304 is positioned behind the user 302 and is facing substantially upwards. In the backswing position 312, the swing training device 100 is maintained between the forearms 310 of the user 302 by the arm attachment 126 and the pressure or force exerted by the user's forearms 310. Between the starting position 306 and the backswing position 312, if the amount of force applied by the forearms 310 of the user 302 on the body 102 increases, the first end region 108 and second end region 112 may overlap further, as the attachment member(s) 202 slide in a first direction within the receiving slot 116, such that the diameter of the interior area 104 decreases. Conversely, if the force applied on the body 102 is decreased, the first end region 108 and second end region 112 may overlap less, as the attachment members 202 slide in a second direction within the receiving slot 116, such that the diameter of the interior area 104 increases. As such, the position of the elbows 314 may continue to adjust the amount of overlap between the first end region 108 and the second end region 112 throughout the swing of the golf club 304.

FIG. 11C shows the user 302 in a forward swing position 316, where the golf club 304 is moving forward from the backswing position 312 and downward such that the head 308 of the golf club 304 approaches the ground in front of the user 302. The body 102 of the swing training device 100 may maintain the same or similar interior area 104 as in the starting position 306 or as in the backswing position 312. Alternatively, based on the amount of force applied on the body 102 of the swing training device 100 by the user's forearms 310, the amount of overlap between the first end region 108 and second end region 112 may change (increase or decrease). As discussed previously, the body 102 of the swing training device 100 may provide "resistance" (at least partially) during the swing of the golf club 304, such that if pressure if reduced by the forearms 310 on the body 102, the body 102 may maintain a similar interior area 104 throughout the swing. This process may be continued for repeated swings of the golf club 304, and then removed from the forearm(s) 310.

While discussed herein that the swing training device 100 includes a first end region 108 and second end region 112 which overlap, it is further contemplated that the body 102 of the swing training device 100 may be a closed loop shape, which is fully connected circumferentially, for example by an end of the device being received in a slot or opening in a second end of the device. As such, the interior area 104 may be adjusted by similarly applying force on the exterior surface 114, which may cause the exterior surface 114 to deform (such as due to deformable material) to provide an appropriate spacing (sizing) for the swing training device 100 between forearms 310 of the user 302.

While discussed herein that a first end region 108 and a second end region 112 may move relative to one another even while coupled together via attachment members 202, in some aspects the first end region 108 and second end region 112 may be fixedly positioned relative to one another when coupled together via the attachment members 202. In such an aspect, the attachment members 202 may not slide within the receiving slot 116, though the swing training device 100 may still be sized to a particular user 302 based on the selected fixed position of the end regions 108, 112. In such an aspect, the swing training device 100 may still bend or flex in response to an application of force or pressure from a user's forearms 310 during use, such that the body 102 flexes, bends or otherwise deforms while the end regions 108, 112 remain fixedly coupled to one another via the attachment members 202.

EXAMPLES

A collection of exemplary embodiments, including at least some explicitly enumerated as "Examples" providing additional description of a variety of example types in accordance with the concepts described herein are provided below. These examples are not meant to be mutually exclusive, exhaustive, or restrictive; and the invention is not limited to these examples but rather encompasses all possible modifications and variations within the scope of the issued claims and their equivalents.

Example 1. A swing training device for practicing a sports swing including a body including a first end region proximate a first end of the body and a second end region proximate a second end of the body opposite the first end of the body: a receiving slot extending along the body; and at least one attachment member received within the receiving slot and adapted to couple the first end region and the second end region such that the first end region and the second end region overlap each other and such that the body defines a hollow shape having an area, wherein the first end region and the second end region are adapted to translate relative to each other.

Example 2. The swing training device of any of the preceding or subsequent examples or combination of examples, wherein the hollow shape is generally that of a circle or oval.

Example 3. The swing training device of any of the preceding or subsequent examples or combination of examples, wherein the body has a circumference and wherein the receiving slot extends around only a portion of the circumference of the body.

Example 4. The swing training device of any of the preceding or subsequent examples or combination of examples, wherein the receiving slot extends around 25% to 75% of the circumference of the body.

Example 5. The swing training device of any of the preceding or subsequent examples or combination of examples, wherein the circumference is configured to decrease when a force is applied to the body.

Example 6. The swing training device of any of the preceding or subsequent examples or combination of examples, wherein the body further includes an exterior surface.

Example 7. The swing training device of any of the preceding or subsequent examples or combination of examples, wherein at least a portion of the exterior surface curves concavely.

Example 8. The swing training device of any of the preceding or subsequent examples or combination of examples, further including a comfort member configured to couple to the exterior surface of the body.

Example 9. The swing training device of any of the preceding or subsequent examples or combination of examples, wherein the hollow shape includes a cross-wise dimension and wherein the cross-wise dimension is configured to decrease when a force is applied to the exterior surface of the body.

Example 10. The swing training device of any of the preceding or subsequent examples or combination of examples, wherein the cross-wise dimension of the hollow shape is configured to increase when the force applied to the exterior surface of the body is removed.

Example 11. The swing training device of any of the preceding or subsequent examples or combination of examples, wherein the at least one attachment member is configured to move within the receiving slot to adjust an amount of overlap between the first end region and the second end region.

Example 12. The swing training device of any of the preceding or subsequent examples or combination of examples, further including an opening extending through the body, wherein the at least one attachment member is configured to be inserted through the opening and received within the receiving slot.

Example 13. The swing training device of any of the preceding or subsequent examples or combination of examples, wherein the receiving slot includes a first end and a second end, wherein the first end of the receiving slot is more proximate the second end region of the body, and wherein the opening is more proximate the first end region of the body.

Example 14. The swing training device of any of the preceding or subsequent examples or combination of examples, wherein the at least one attachment member prevents the first end region and the second end region from translating relative to each other beyond the first end and the second end of the receiving slot.

Example 15. The swing training device of any of the preceding or subsequent examples or combination of examples, wherein the at least one attachment member is incorporated into the body.

Example 16. The swing training device of any of the preceding or subsequent examples or combination of examples, wherein the body includes a deformable material.

Example 17. The swing training device of any of the preceding or subsequent examples or combination of examples, wherein the body is configured to flex in response to an application of force, while the first end region and the second end region are configured to remain coupled to one another using the at least one attachment member.

Example 18. The swing training device of any of the preceding or subsequent examples or combination of examples, wherein the receiving slot extends at a substantially uniform height along the body.

Example 19. The swing training device of any of the preceding or subsequent examples or combination of examples, further including an arm attachment coupled to the body and configured to couple to an arm of a user.

Example 20. A swing training device for practicing a sports swing including: a body including a first end region proximate a first end and a second end region proximate a second end: at least one receiving slot extending along the body; and at least one attachment member received within the at least one receiving slot and adapted to couple the first end region and the second end region in fixed relation such that the body defines a hollow shape having an area, wherein the body is adapted to deform to alter the hollow shape.

Different arrangements of the components described above, as well as components and steps not shown or described are possible. Similarly, some features and subcombinations are useful and may be employed without reference to other features and subcombinations.

Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

Although certain exemplary embodiments of the disclosure have been shown and described in detail, it should be understood that various changes and modifications may be made therein without departing from the scope of the appended claims. Unless defined otherwise, all technical and scientific terms used herein have the same meaning as commonly understood by one of ordinary skill in the art to which this invention belongs.

It must be noted that as used herein and in the appended claims, the singular forms “a”, “an”, and “the” include plural referents unless the context clearly dictates otherwise. Although the terms “first”, “second”, etc. may be used herein to describe various elements, components, regions, layers and/or sections, it should be understood that they should not be limited by these terms. These terms are used only to distinguish one element, component, region, layer, or section from another region, layer, or section. Thus, a first element, component, region, layer, or section discussed above could be termed a second element, component, region, layer, or section without departing from the teachings of the present invention.

What is claimed is:

1. A swing training device for practicing a sports swing, the swing training device comprising:

a body comprising a first end region proximate a first end of the body and a second end region proximate a second end of the body opposite the first end of the body, the body further comprising an exterior surface adapted to contact each forearm of a user during the sports swing;

a receiving slot extending along the body; and at least one attachment member received within the receiving slot and adapted to couple the first end region and the second end region such that the first end region and the second end region overlap each other and such that the body defines a hollow shape having an area, wherein the first end region and the second end region are adapted to translate relative to each other by virtue of force applied to the body by each of the forearms of the user.

2. The swing training device of claim 1, wherein the hollow shape is generally that of a circle or oval.

3. The swing training device of claim 2, wherein the body has a circumference and wherein the receiving slot extends around only a portion of the circumference of the body.

4. The swing training device of claim 3, wherein the receiving slot extends around 25% to 75% of the circumference of the body.

5. The swing training device of claim 3, wherein the circumference is configured to decrease when the force is applied to the body.

6. The swing training device of claim 1, wherein at least a portion of the exterior surface curves concavely.

7. The swing training device of claim 1, wherein the hollow shape comprises a cross-wise dimension and wherein the cross-wise dimension is configured to decrease when the force is applied to the body.

8. The swing training device of claim 7, wherein the cross-wise dimension of the hollow shape is configured to increase when the force applied to the body is removed.

9. The swing training device of claim 1, wherein the at least one attachment member is configured to move within the receiving slot to adjust an amount of overlap between the first end region and the second end region.

10. The swing training device of claim 1, further comprising an opening extending through the body, wherein the at least one attachment member is configured to be inserted through the opening and received within the receiving slot.

11. The swing training device of claim 10, wherein the receiving slot comprises a first end and a second end, wherein the first end of the receiving slot is more proximate the second end region of the body, and wherein the opening is more proximate the first end region of the body.

12. The swing training device of claim 11, wherein the at least one attachment member prevents the first end region and the second end region from translating relative to each other beyond the first end and the second end of the receiving slot.

13. The swing training device claim 12, wherein the at least one attachment member is incorporated into the body.

14. The swing training device of claim 1, wherein the body comprises a deformable material.

15. The swing training device of claim 1, wherein the body is configured to flex in response to an application of force, while the first end region and the second end region are configured to remain coupled to one another using the at least one attachment member.

16. The swing training device of claim 1, wherein the receiving slot extends at a substantially uniform height along the body.

17. The swing training device of claim 1, further comprising an arm attachment coupled to the body and configured to couple to an arm of the user.

18. The swing training device of claim 1, further comprising a comfort member configured to couple to the exterior surface of the body.

19. A swing training device for practicing a sports swing, the swing training device comprising:

a body comprising a first end region proximate a first end and a second end region proximate a second end, the body further comprising an exterior surface adapted to contact each forearm of a user during the sports swing;

at least one receiving slot extending along the body; and at least one attachment member received within the at least one receiving slot and adapted to couple the first end region and the second end region in fixed relation such that the body defines a hollow shape having an area, wherein the body is adapted to deform to alter the hollow shape by virtue of force applied to the body by each of the forearms of the user.

20. The swing training device of claim 19, wherein at least a portion of the exterior surface curves concavely.

* * * * *